US008984887B2

(12) United States Patent
Berry

(10) Patent No.: US 8,984,887 B2
(45) Date of Patent: Mar. 24, 2015

(54) COMBUSTOR AND METHOD FOR SUPPLYING FUEL TO A COMBUSTOR

(75) Inventor: Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 801 days.

(21) Appl. No.: 13/244,526

(22) Filed: Sep. 25, 2011

(65) Prior Publication Data

US 2013/0074510 A1 Mar. 28, 2013

(51) Int. Cl.
*F23R 3/28* (2006.01)
*F23R 3/36* (2006.01)

(52) U.S. Cl.
CPC .. *F23R 3/286* (2013.01); *F23R 3/36* (2013.01)
USPC ..... 60/737

(58) Field of Classification Search
CPC ..... F23R 3/28; F23R 3/32; F23R 3/36; F23R 3/286; F02C 7/22; F02C 7/222
USPC ..... 60/39.463, 734, 737, 739, 740, 742, 60/746, 747, 772
See application file for complete search history.

(56) References Cited

U.S. PATENT DOCUMENTS

| | | | | |
|---|---|---|---|---|
| 3,771,500 | A | | 11/1973 | Shakiba |
| 4,100,733 | A | * | 7/1978 | Striebel et al. ..... 60/39.463 |
| 4,104,873 | A | | 8/1978 | Coffinberry |
| 4,412,414 | A | | 11/1983 | Novick et al. |
| 5,104,310 | A | | 4/1992 | Saltin |
| 5,205,120 | A | | 4/1993 | Oblander et al. |
| 5,213,494 | A | | 5/1993 | Jeppesen |
| 5,341,645 | A | | 8/1994 | Ansart et al. |
| 5,439,532 | A | | 8/1995 | Fraas |
| 5,592,819 | A | | 1/1997 | Ansart et al. |
| 5,707,591 | A | | 1/1998 | Semedard et al. |
| 6,098,407 | A | | 8/2000 | Korzendorfer et al. |
| 6,123,542 | A | | 9/2000 | Joshi et al. |
| 6,394,791 | B2 | | 5/2002 | Smith et al. |
| 6,438,961 | B2 | | 8/2002 | Tuthill et al. |
| 6,796,790 | B2 | | 9/2004 | Venizelos et al. |
| 6,983,600 | B1 | | 1/2006 | Dinu et al. |

(Continued)

OTHER PUBLICATIONS

Co-pending and commonly assigned U.S. Appl. No. 12/499,777, filed Jul. 8, 2009.

(Continued)

*Primary Examiner* — Phutthiwat Wongwian
*Assistant Examiner* — Thomas Burke
(74) *Attorney, Agent, or Firm* — Dority & Manning, PA

(57) ABSTRACT

A combustor includes an end cap having an upstream surface axially separated from a downstream surface and a cap shield circumferentially surrounding the upstream and downstream surfaces. A first circuit of tubes extends from the upstream surface through the downstream surface. A first fuel plenum is in fluid communication with the first circuit of tubes. A second circuit of tubes extends from the upstream surface through the downstream surface. A second fuel plenum downstream from the first fuel plenum is in fluid communication with the second circuit of tubes. A method for supplying fuel to a combustor includes flowing a working fluid through tubes, flowing fuel or diluent from a first fuel plenum through a first circuit of tubes, and flowing fuel or diluent from a second fuel plenum through a second circuit of tubes, wherein the second fuel plenum is downstream from the first fuel plenum.

18 Claims, 6 Drawing Sheets

(56) References Cited

U.S. PATENT DOCUMENTS

| | | | | |
|---|---|---|---|---|
| 7,003,958 | B2 | 2/2006 | Dinu et al. | |
| 7,007,478 | B2 | 3/2006 | Dinu | |
| 7,631,499 | B2 | 12/2009 | Bland | |
| 7,752,850 | B2 | 7/2010 | Laster et al. | |
| 8,181,891 | B2 * | 5/2012 | Ziminsky et al. | 239/430 |
| 2004/0216463 | A1 | 11/2004 | Harris | |
| 2008/0016876 | A1 | 1/2008 | Colibaba-Evulet et al. | |
| 2008/0304958 | A1 | 12/2008 | Norris et al. | |
| 2009/0229269 | A1 * | 9/2009 | Lacy et al. | 60/737 |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 * | 2/2010 | Zuo | 60/740 |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0180602 | A1 * | 7/2010 | Johnson et al. | 60/760 |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016866 | A1 * | 1/2011 | Boardman et al. | 60/730 |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 * | 4/2011 | Zuo et al. | 60/737 |
| 2011/0089266 | A1 | 4/2011 | Stoia et al. | |
| 2011/0314827 | A1 * | 12/2011 | Khosla et al. | 60/742 |
| 2012/0031102 | A1 * | 2/2012 | Uhm et al. | 60/776 |
| 2013/0045450 | A1 * | 2/2013 | Uhm et al. | 431/8 |

OTHER PUBLICATIONS

Co-pending and commonly assigned U.S. Appl. No. 121877,385, filed Sep. 8, 2010.

Co-pending and commonly assigned U.S. Appl. No. 12/877,399, filed Sep. 8, 2010.

Co-pending and commonly assigned U.S. Appl. No. 13/020,156, filed Feb. 3, 2011 5.

* cited by examiner

COMBUSTOR AND METHOD FOR SUPPLYING FUEL TO A COMBUSTOR

FIELD OF THE INVENTION

The present invention generally involves a combustor and method for supplying fuel to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, localized hot streaks in the combustion chamber may increase the disassociation rate of diatomic nitrogen, increasing the production of nitrogen oxides ($NO_x$) at higher combustion gas temperatures. Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of tubes may be radially arranged in an end cap to provide fluid communication for the working fluid and fuel flowing through the end cap and into the combustion chamber. The tubes enhance mixing between the working fluid and fuel to reduce hot streaks that can be problematic with higher combustion gas temperatures. As a result, the tubes are effective at preventing flashback or flame holding and/or reducing $NO_x$ production, particularly at higher operating levels. However, an improved combustor and method for supplying fuel to the tubes that allows for staged fueling or operation of the tubes at varying operational levels would be useful.

BRIEF DESCRIPTION OF THE INVENTION

Aspects and advantages of the invention are circuit forth below in the following description, or may be obvious from the description, or may be learned through practice of the invention.

One embodiment of the present invention is a combustor that includes an end cap that extends radially across at least a portion of the combustor, wherein the end cap comprises an upstream surface axially separated from a downstream surface and a cap shield circumferentially surrounding the upstream and downstream surfaces. A first circuit of tubes extends from the upstream surface through the downstream surface, and a first fuel plenum in the end cap is in fluid communication with the first circuit of tubes. A second circuit of tubes extends from the upstream surface through the downstream surface, and a second fuel plenum in the end cap downstream from the first fuel plenum is in fluid communication with the second circuit of tubes.

Another embodiment of the present invention is a combustor that includes an end cap that extends radially across at least a portion of the combustor, wherein the end cap comprises an upstream surface axially separated from a downstream surface and a cap shield circumferentially surrounding the upstream and downstream surfaces. A first barrier extends radially in the end cap between the upstream and downstream surfaces. A first plenum is upstream from the first barrier, and a second plenum is downstream from the first barrier. A plurality of tubes extends from the upstream surface through the first barrier and the downstream surface to provide fluid communication through the end cap. A first conduit is in fluid communication with the first plenum, and a second conduit is in fluid communication with the second plenum.

The present invention may also include a method for supplying fuel to a combustor. The method includes flowing a working fluid through a plurality of tubes that extend axially through an end cap that extends radially across at least a portion of the combustor. The method further includes flowing a first fuel from a first fuel plenum in the end cap through a first circuit of the plurality of tubes and flowing a second fuel from a second fuel plenum in the end cap through a second circuit of the plurality of tubes, wherein the second fuel plenum is downstream from the first fuel plenum.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is circuit forth more particularly in the remainder of the specification, including reference to the accompanying figures, in which.

DETAILED DESCRIPTION OF THE INVENTION

Figure 1:
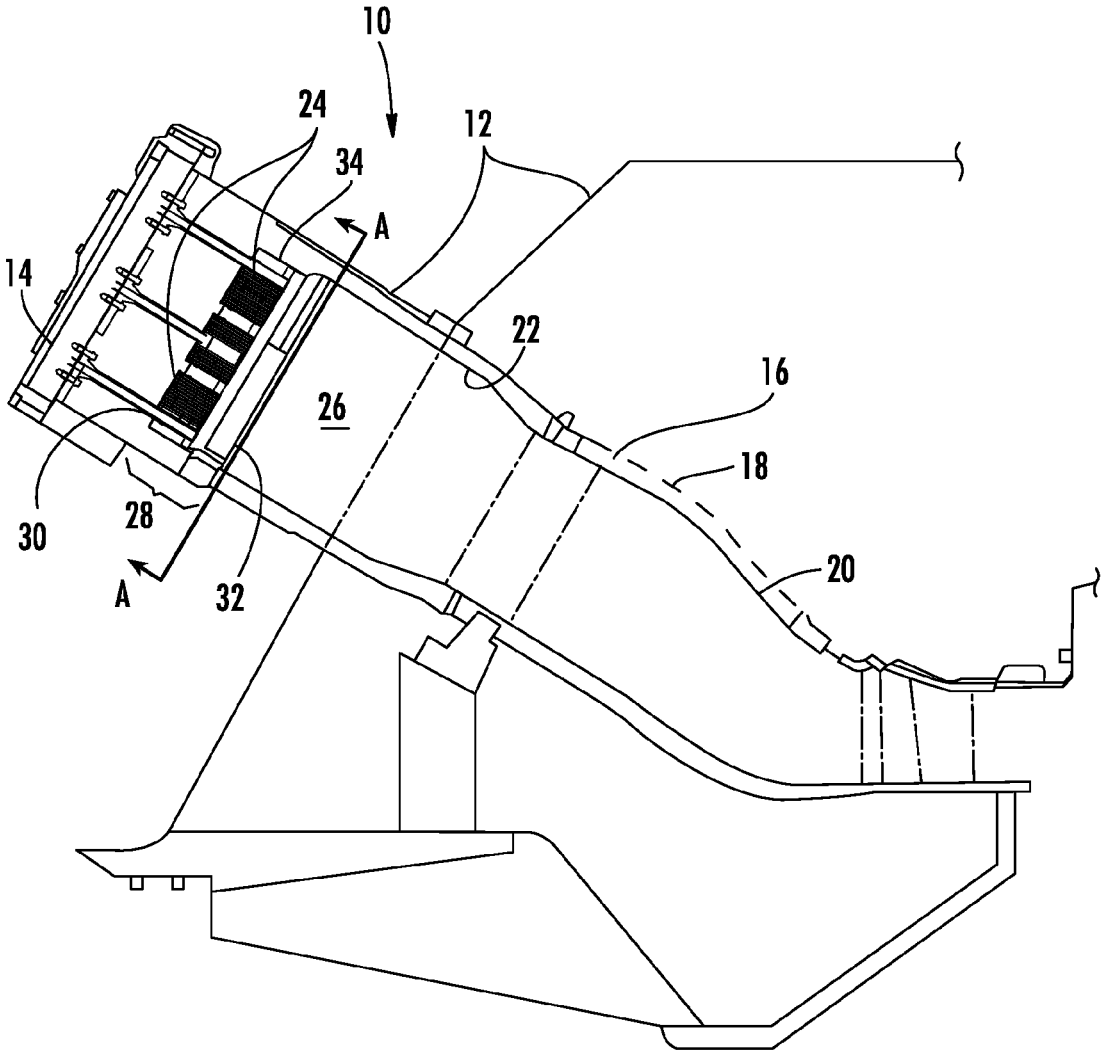
FIG. 1 is a simplified cross-section view of an exemplary combustor within the scope of various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a combustor and method for supplying fuel to a combustor. In particular embodiments, a plurality of tubes arranged in an end cap enhance mixing between a working fluid, a fuel, and/or a diluent prior to combustion. The working fluid flows through the tubes, and the fuel and/or diluent may be supplied to the tubes through one or more fluid conduits. The tubes may be grouped into multiple circuits that enable flow rates of the fuel and/or the diluent to be varied between each circuit. In this manner, the combustor may be operated over a wide range of operating conditions without exceeding design margins associated with flashback, flame holding, combustion dynamics, and/or emissions limits. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims. In addition, as used herein, the terms "first", "second", and "third" may be used interchangeably to distinguish one component from another and are not intended to signify particular structure, location, function, or importance of the individual components.

FIG. 1 shows a simplified cross-section view of an exemplary combustor 10, such as would be included in a gas turbine, within the scope of various embodiments of the present invention. A casing 12 and an end cover 14 may surround the combustor 10 to contain a working fluid flowing to the combustor 10. The working fluid may pass through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through a plurality of tubes 24 into a combustion chamber 26.

The tubes 24 are radially arranged in an end cap 28 upstream from the combustion chamber 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A. As shown, the end cap 28 generally extends radially across at least a portion of the combustor 10 and includes an upstream surface 30 axially separated from a downstream surface 32 and a cap shield 34 that circumferentially surrounds the upstream and downstream surfaces 30, 32. Each tube 24 extends from the upstream surface 30 through the downstream surface 32 of the end cap 28 to provide fluid communication for the working fluid to flow through the end cap 28 and into the combustion chamber 26.

Figure 2:
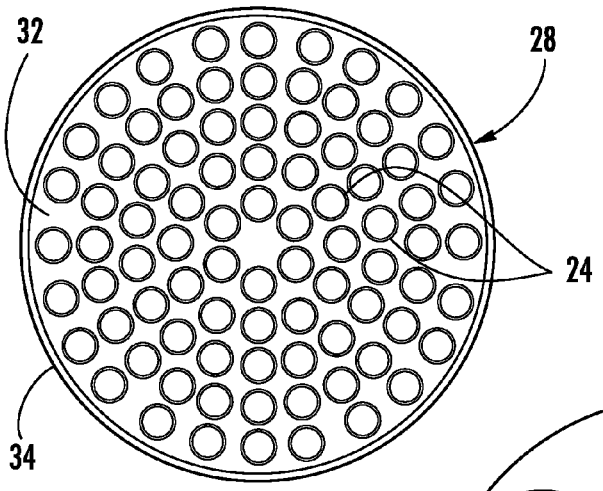
FIG. 2 is a cross-section view of the end cap shown in FIG. 1 taken along line A-A according to an embodiment of the present invention.
Figure 3:
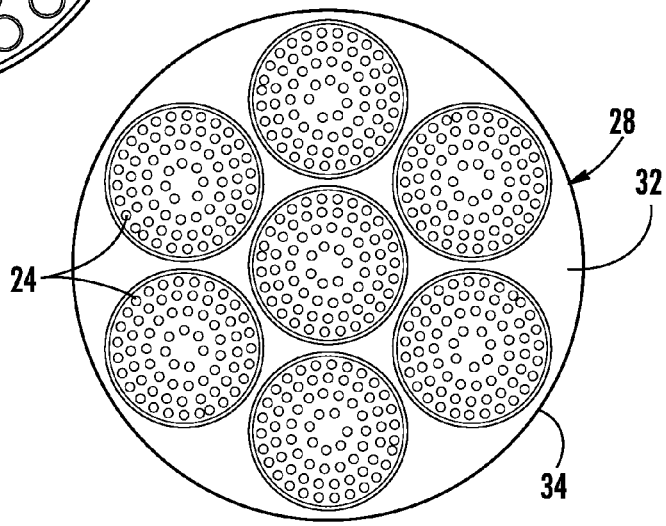
FIG. 3 is a cross-section view of the end cap shown in FIG. 1 taken along line A-A according to an embodiment of the present invention.
Figure 4:
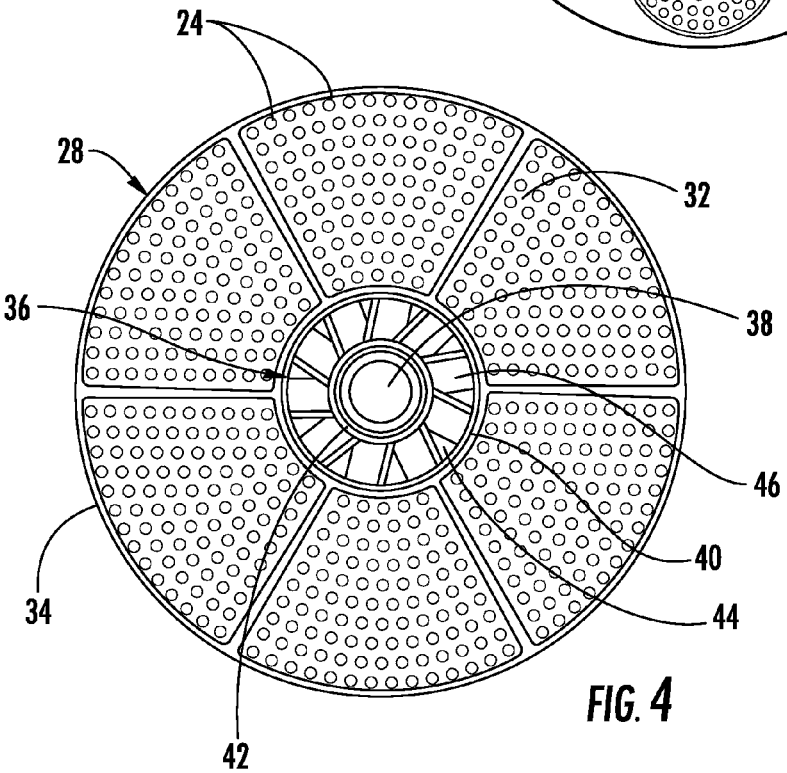
FIG. 4 is a cross-section view of the end cap shown in FIG. 1 taken along line A-A according to an embodiment of the present invention.

Various embodiments of the combustor 10 may include different numbers, shapes, and arrangements of tubes 24 separated into various groups across the end cap 28. The tubes 24 in each group may be grouped in circular, triangular, square, or other geometric shapes, and the groups may be arranged in various numbers and geometries in the end cap 28. Although generally illustrated as cylindrical tubes in each embodiment, the cross-section of the tubes 24 may be any geometric shape, and the present invention is not limited to any particular cross-section unless specifically recited in the claims. FIG. 2 shows the tubes 24 radially arranged across the end cap 28, and FIG. 3 shows the tubes 24 arranged, for example, in six groups radially surrounding a single group. FIG. 4 shows five pie-shaped groups of tubes 24 arranged around a single fuel nozzle 36 aligned with an axial centerline 38 of the end cap 28. The fuel nozzle 36 may include a shroud 40 that circumferentially surrounds a center body 42 to define an annular passage 44 between the shroud 40 and the center body 42. One or more swirler vanes 46 may be located between the shroud 40 and the center body 42 to impart swirl to the working fluid flowing through the annular passage 44. In this manner, the fuel nozzle 36 may provide fluid communication through the end cap 28 to the combustion chamber 26 separate and apart from the tubes 24.

Figure 5:
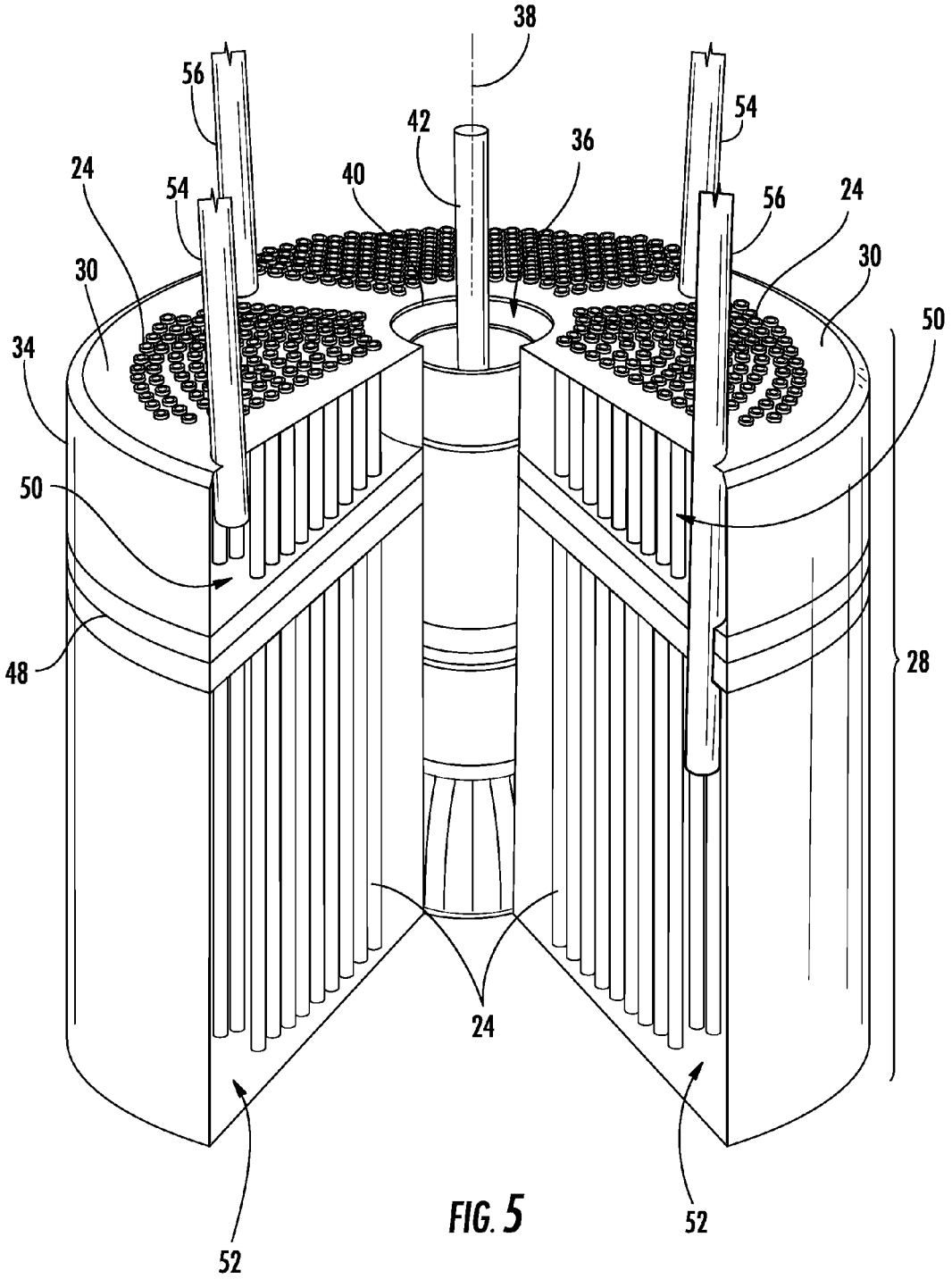
FIG. 5 is a simplified partial perspective view of the end cap shown in FIG. 4.

FIG. 5 provides a simplified partial perspective view of the end cap 28 shown in FIG. 4. As shown in FIG. 5, a first barrier 48 may extend radially in the end cap 28 between the upstream and downstream surfaces 30, 32 to define a first plenum 50 upstream from the first barrier 48 and a second plenum 52 downstream from the first barrier 48. First and second conduits 54, 56 may extend from the end cover 14 or casing 12 to provide fluid communication with the first and second plenums 50, 52, respectively. In this manner, the first and second conduits 54, 56 may supply a fuel and/or a diluent to the respective first and second plenums 50, 52.

Figure 6:
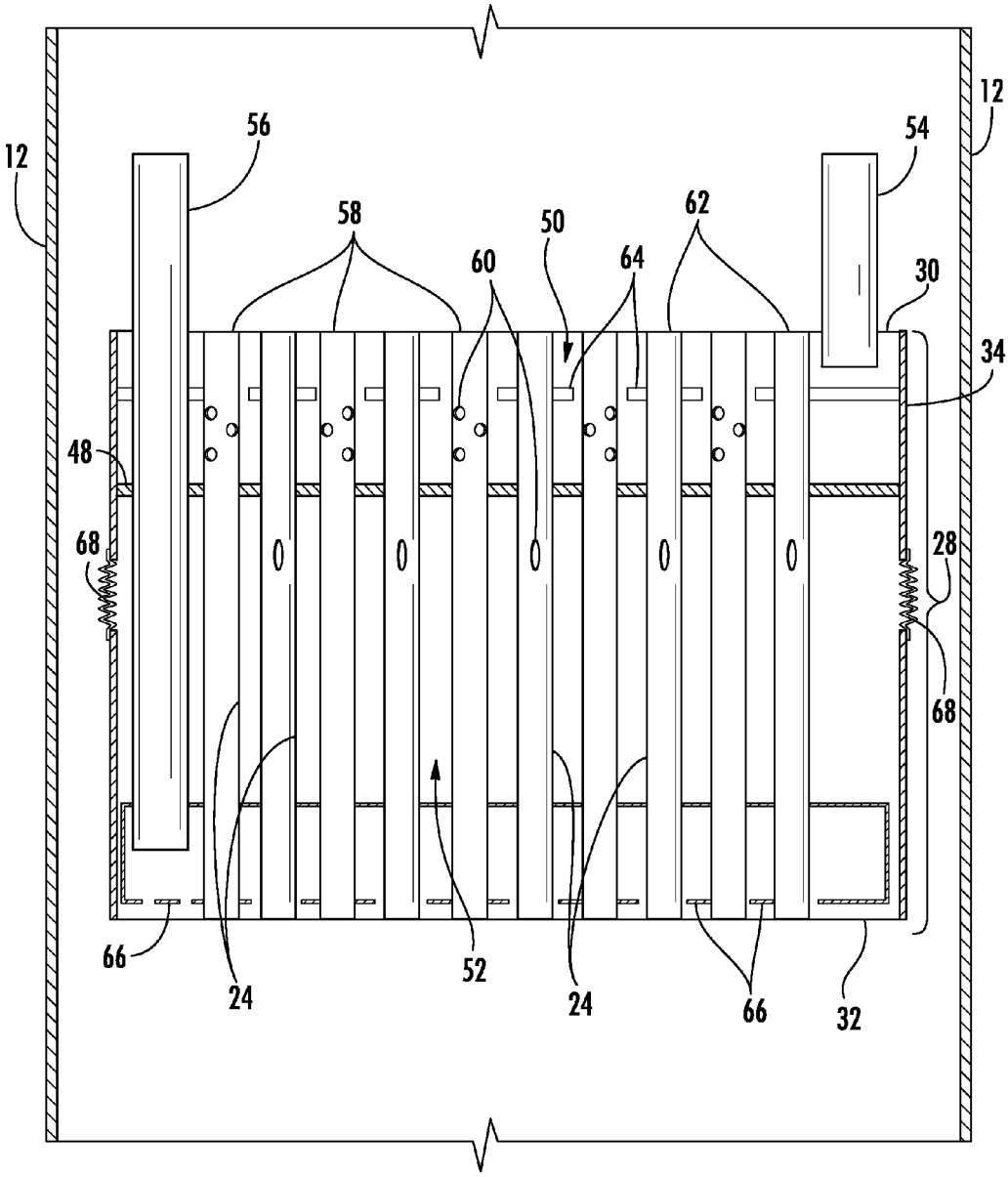
FIG. 6 is an enlarged cross-section view of a portion of the end cap shown in FIG. 5 according to a first embodiment of the present invention.

FIG. 6 provides an enlarged cross-section view of a portion of the end cap 28 shown in FIG. 5 according to a first embodiment of the present invention. As shown, the first barrier 48 extends radially in the end cap 28 between the upstream and downstream surfaces 30, 32, and the tubes 24 extend from the upstream surface 30 through the first barrier 48 and the downstream surface 32 to provide fluid communication through the end cap 28. As further shown, the first conduit 54 is in fluid communication with the first plenum 50, and the second conduit 56 is in fluid communication with the second plenum 52.

The tubes 24 may be arranged into multiple circuits that enable varying flow rates of the fuel and/or the diluent to each circuit. For example, as shown in FIG. 6, a first circuit 58 of tubes 24 may include one or more fluid passages 60 that provide fluid communication from the first plenum 50 through each tube 24 in the first circuit 58, and a second circuit 62 of tubes 24 may include one or more fluid passages 60 that provide fluid communication from the second plenum 52 through each tube 24 in the second circuit 62. The fluid passages 60 may be angled radially, axially, and/or azimuthally to project and/or impart swirl to the fuel and/or diluent flowing through the fluid passage 60 and into the tubes 24. The end cap 28 may further include one or more baffles that extend radially in the first and or second plenums 50, 52 to distribute fluid flow in the respective plenums. For example, as shown in FIG. 6, a first baffle 64 may extend radially in the first plenum 50 between the upstream surface 30 and the barrier 48, and a second baffle 66 may extend radially in the second plenum 52 between the barrier 48 and the downstream surface 32.

In the particular embodiment shown in FIG. 6, the working fluid may flow outside the end cap 28 until it reaches the end cover 14 and reverses direction to flow through the tubes 24 in the first and second circuits 58, 62. In addition, fuel and/or diluent may be supplied through the first conduit 54 to the first plenum 50. The fuel and/or diluent may flow around the tubes 24 in the first plenum 50 to provide convective cooling to the tubes 24 before flowing across the first baffle 64 and through the fluid passages 60 in the first circuit 58 of tubes 24 to mix with the working fluid flowing through the first circuit 58 of tubes 24. Similarly, fuel and/or diluent may be supplied through the second conduit 56 to the second plenum 52. The fuel and/or diluent supplied through the second conduit 56 may be identical to or different from the fuel and/or diluent supplied through the first conduit 54. The fuel and/or diluent may flow across the second baffle 66 to provide impingement cooling to the downstream surface 32 before flowing around the tubes 24 in the second plenum 52 to provide convective cooling to the tubes 24 before flowing through the fluid passages 60 in the second circuit 62 of tubes 24 to mix with the working fluid flowing through the second circuit 62 of tubes 24. The fuel-working fluid mixture from each circuit 58, 62 of tubes 24 may then flow into the combustion chamber 26.

The temperature of the fuel and working fluid flowing around and/or through the tubes 24 may vary considerably during combustor 10 operations. As a result, the end cap 28 may further include one or more expansion joints or bellows between the upstream and downstream surfaces 30, 32 to allow for thermal expansion of the tubes 24 between the upstream and downstream surfaces 30, 32. For example, as shown in FIG. 6, an expansion joint 68 in the cap shield 34 may allow for axial displacement of the upstream and downstream surfaces 30, 32 as the tubes 24 expand and contract. One of ordinary skill in the art will readily appreciate that alternate locations and/or combinations of expansion joints between the upstream and downstream surfaces 30, 32 are within the scope of various embodiments of the present invention, and the specific location or number of expansion joints is not a limitation of the present invention unless specifically recited in the claims.

Figure 7:
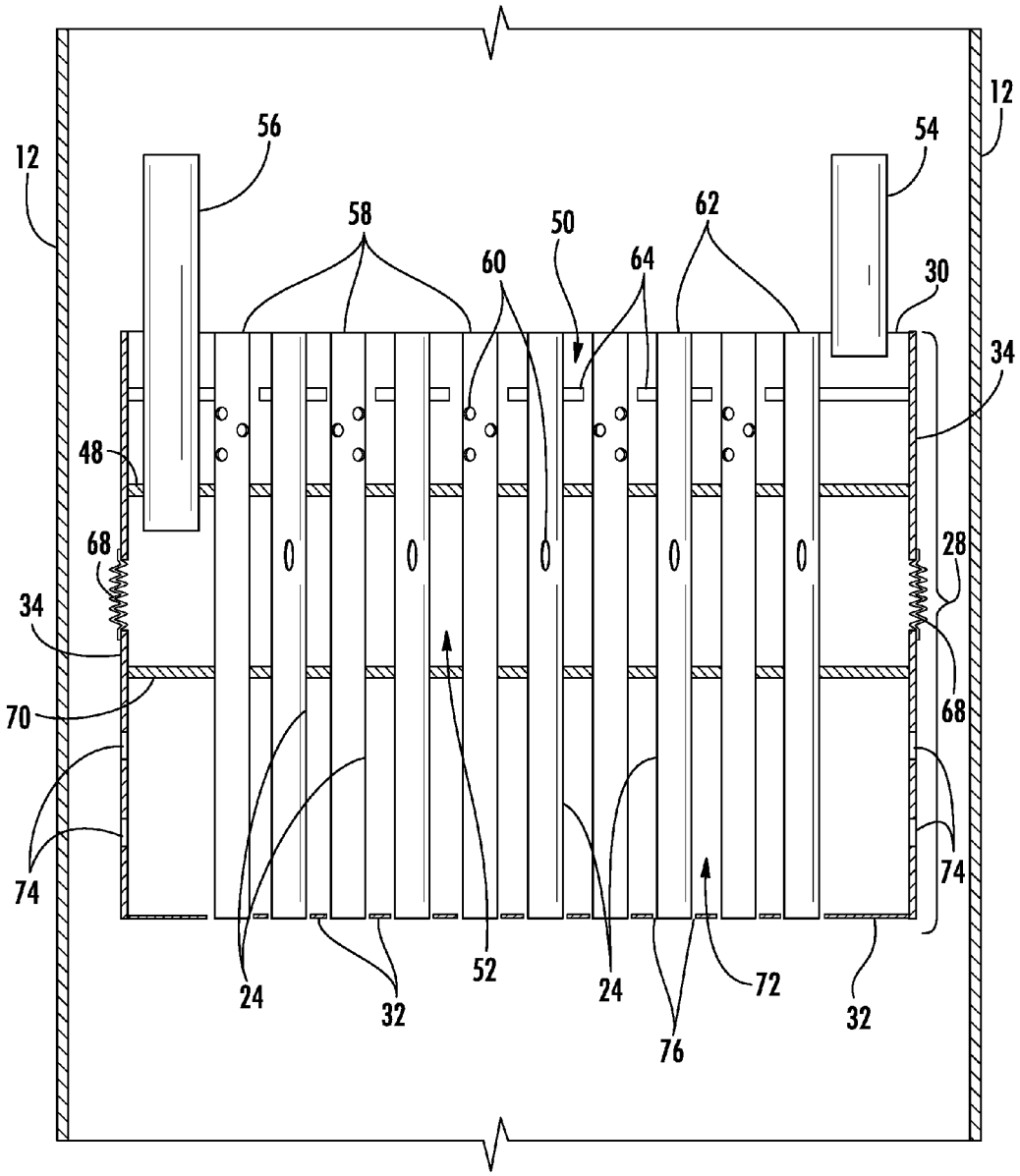
FIG. 7 is an enlarged cross-section view of a portion of the end cap shown in FIG. 5 according to a second embodiment of the present invention.

FIG. 7 provides an enlarged cross-section view of a portion of the end cap 28 shown in FIG. 5 according to a second embodiment of the present invention. In this particular embodiment, a second barrier 70 extends radially in the end cap 28 between the first barrier 48 and the downstream surface 32 to at least partially define a third plenum 72 in the end cap 28 downstream from the second barrier 70. Specifically, the second barrier 70, downstream surface 32, and cap shield 34 define the third plenum 72. In addition, one or more ports 74 through the cap shield 34 provide fluid communication through the cap shield 34 to the third plenum 72. In this manner, at least a portion of the working fluid may flow into the third plenum 72 to flow around the first and/or second circuits 58, 62 of tubes 24 to provide convective cooling to the tubes 24. The working fluid may then flow through gaps 76 between the downstream surface 32 and the tubes 24 before flowing into the combustion chamber 26.

Figure 8:
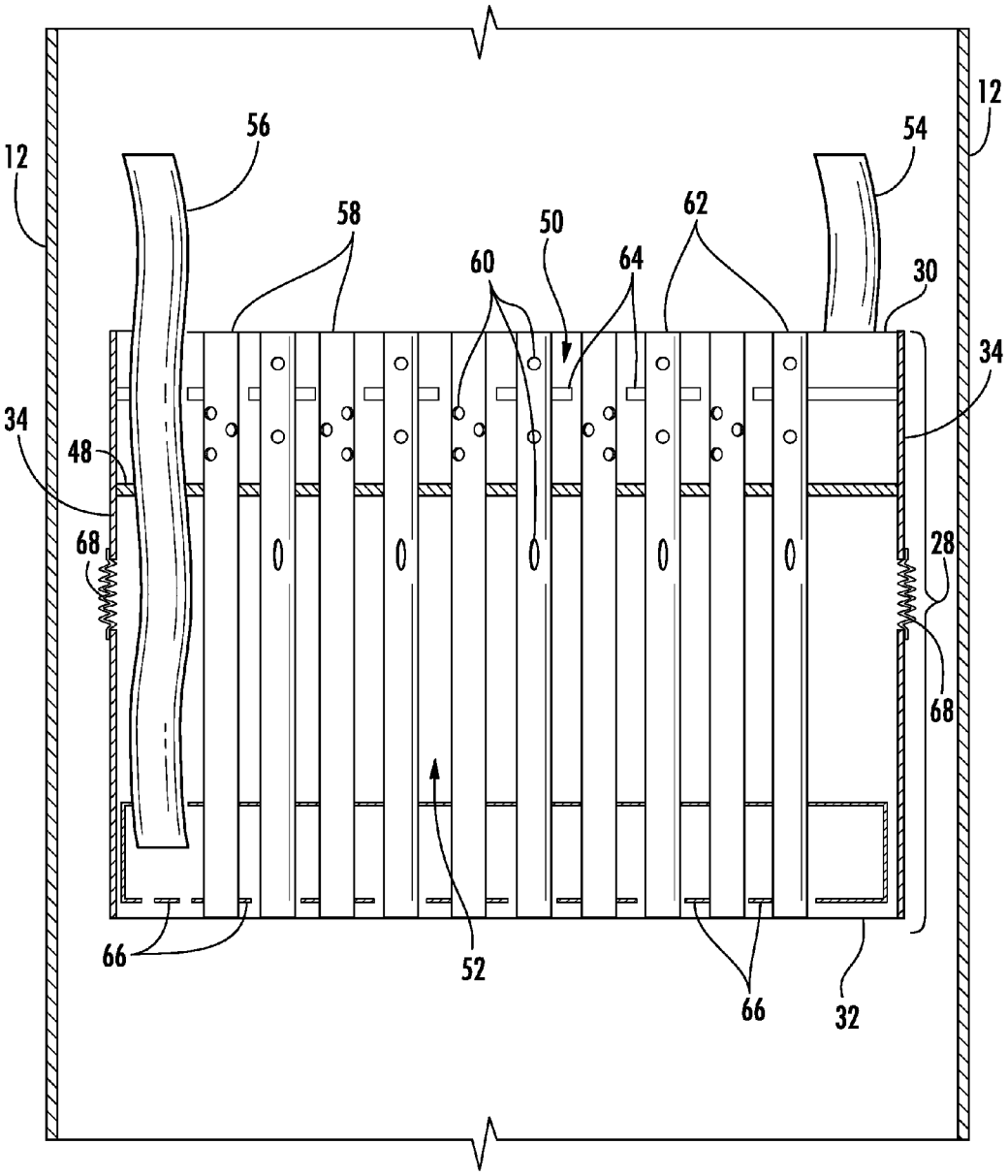
FIG. 8 is an enlarged cross-section view of a portion of the end cap shown in FIG. 5 according to a third embodiment of the present invention.

FIG. 8 provides an enlarged cross-section view of a portion of the end cap 28 shown in FIG. 5 according to a third embodiment of the present invention. In this particular embodiment, the first and second conduits 54, 56 are curved to more readily absorb thermal expansion and contraction in the combustor 10. In addition, the second circuit 62 of tubes 24 includes fluid passages 60 that provide fluid communication from both the first and second plenums 50, 52 through one or more tubes 24 in the second circuit 62. As a result, fuel and/or diluent supplied to the first circuit 58 of tubes 24 may also be supplied to one or more tubes 24 in the second circuit 62.

The axial position, number, and size of the fluid passages 60 in each circuit 58, 62 may be selected to optimize the fuel flow through each tube 24 at various operating levels while also enhancing the combustion dynamics. Specifically, the fluid passages 60 upstream from the first baffle 64 allow more time for convective mixing between the fuel and working fluid compared to the fluid passages 60 downstream from the first baffle 64, which in turn allow more time for convective mixing compared to the fuel passages 60 downstream from the first barrier 48. Similarly, the fluid pressure in the first plenum 50 upstream from the first baffle 64 is generally greater than the fluid pressure downstream from the first baffle 64, and the fluid pressure in the second plenum. 52 may be controlled independently from the fluid pressure in the first plenum 50. As a result, the axial position, number, and size of the fluid passages 60 may be selected to achieve the optimum fuel flow and convective mixing for each operating level. In addition, the axial position, number, and size of the fluid passages 60 may be adjusted between the first and second circuits 58, 62 to reduce any harmonic interaction between individual tubes 24 to enhance the combustion dynamics produced in the combustor 10.

The various embodiments shown in FIGS. 1-8 provide multiple combinations of methods for supplying fuel to the combustor 10. As shown in FIGS. 6-8 for example, the method may include flowing the working fluid through the tubes 24, flowing a first fuel from the first fuel plenum 50 through the first circuit 58 of tubes 24, and flowing a second fuel from the second fuel plenum 52 through the second circuit 62 of tubes 24. As previously stated, the first and second fuels and diluents may be the same or different. The method may further include flowing at least one of fuel or diluent around one or more baffles 64, 66 that extend radially in the first and/or second fuel plenums 50, 52 and/or flowing the working fluid through the third plenum 72, as shown in the particular embodiment illustrated in FIG. 7. Alternately, or in addition, the method may include flowing the first fuel through the first fuel plenum 50 and the second circuit 62 of tubes 24 and/or flowing a third fuel or diluent through the nozzle 36 aligned with the axial centerline 38 of the end cap 28. One or ordinary skill in the art can readily appreciate these and multiple other methods for staging fuel and/or diluent flow through the tubes 24 to support expanded combustor 10 operations without exceeding design margins associated with flashback, flame holding, combustion dynamics, and/or emissions limits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

an end cap that extends radially and axially within a casing of the combustor, wherein the end cap comprises an upstream surface axially separated from a downstream surface and a cap shield circumferentially surrounding the upstream surface and the downstream surface;

a first fuel plenum defined within the cap shield between the upstream surface and a first barrier;

a first baffle disposed within the first fuel plenum upstream from the first barrier;

a first conduit extending through the upstream surface into the first fuel plenum, wherein the first conduit is oriented to direct a flow of fuel into the first fuel plenum against the first baffle, wherein the flow of fuel is substantially perpendicular to the first baffle:

a first circuit of tubes extending through the upstream surface and the downstream surface within the cap shield, wherein the first circuit of tubes are in fluid communication with the first fuel plenum;

a second fuel plenum defined within the cap shield between the first barrier and the downstream surface;

a second baffle disposed within the second fuel plenum between the first barrier and the downstream surface;

a second conduit extending through the upstream surface, through the first fuel plenum, through the first barrier and into the second fuel plenum, wherein the second conduit is oriented to direct a flow of fuel into the second fuel plenum against the second baffle, wherein the flow of fuel is substantially perpendicular to the second baffle; and a second circuit of tubes extending through the upstream surface and the downstream surface within the cap shield, wherein the second circuit of tubes are in fluid communication with the second fuel plenum.

2. The combustor as in claim 1, wherein at least one tube of the second circuit of tubes is in fluid communication with the first fuel plenum.

3. The combustor as in claim 1, wherein each tube of the first circuit of tubes includes a passage disposed within the first fuel plenum, wherein the passage provides for fluid communication between the first fuel plenum and the tube.

4. The combustor as in claim 3, wherein the passage is disposed within the first fuel plenum between the upstream surface and the first baffle.

5. The combustor as in claim 3, wherein the passage is disposed within the first fuel plenum between the first baffle and the first barrier.

6. The combustor as in claim 1, wherein each tube of the second circuit of tubes includes a passage disposed within the second fuel plenum, wherein the passage provides for fluid communication between the second fuel plenum and the tube.

7. The combustor as in claim 6, wherein the passage is disposed within the second fuel plenum between the first barrier and the second baffle.

8. The combustor as in claim 1, wherein at least one tube of the second circuit of tubes includes a plurality of passages that provide for fluid communication into the at least one tube, wherein at least one passage of the plurality of passages is disposed within the first fuel plenum and at least one passage of the plurality of passages is disposed within the second fuel plenum.

9. The combustor as in claim 8, wherein at least one passage of the plurality of passages is disposed within the first fuel plenum between the upstream surface and the first baffle and at least one passage of the plurality of passages is disposed between the first baffle and the first barrier.

10. The combustor as in claim 8, wherein the at least one passage of the plurality of passages disposed within the first fuel plenum is circular and the at least one passage of the plurality of passages disposed within the second fuel plenum is non-circular.

11. A combustor, comprising:

an end cap that extends radially and axially within a casing of the combustor, wherein the end cap comprises an upstream surface axially separated from a downstream surface and a cap shield circumferentially surrounding the upstream surface and the downstream surface;

a first fuel plenum defined within the cap shield between the upstream surface and a first barrier;

a first conduit extending through the upstream surface into the first fuel plenum, wherein the first conduit is oriented to direct a flow of fuel into the first fuel plenum substantially perpendicular to the first barrier;

a first baffle disposed within the first fuel plenum between the upstream surface and the first barrier, wherein the first conduit is oriented to direct the flow of fuel against the first baffle;

a first circuit of tubes extending through the upstream surface and the downstream surface within the cap shield, wherein the first circuit of tubes are in fluid communication with the first fuel plenum;

a second fuel plenum defined within the cap shield between the first barrier and the downstream surface;

a second conduit extending through the upstream surface, through the first fuel plenum, through the first barrier and into the second fuel plenum, wherein the second conduit is oriented to direct a flow of fuel, steam or diluent into the second fuel plenum substantially perpendicular to the downstream surface; and a second baffle disposed within the second fuel plenum between the first barrier and the downstream surface, wherein the second conduit is oriented to direct the flow of fuel, steam or diluent against the second baffle;

a second circuit of tubes extending through the upstream surface and the downstream surface within the cap shield, wherein the second circuit of tubes are in fluid communication with the second fuel plenum.

12. The combustor as in claim 11, wherein the first conduit is oriented to direct the flow of fuel against the first barrier.

13. The combustor as in claim 11, wherein the second conduit is oriented to direct the flow of fuel, steam or diluent against the downstream surface.

14. The combustor as in claim 11, wherein at least one tube of the second circuit of tubes is in fluid communication with the first fuel plenum.

15. The combustor as in claim 11, wherein each tube of the first circuit of tubes includes a passage disposed within the first fuel plenum, wherein the passage provides for fluid communication between the first fuel plenum and the tube.

16. The combustor as in claim 11, wherein each tube of the second circuit of tubes includes a passage disposed within the second fuel plenum, wherein the passage provides for fluid communication between the second fuel plenum and the tube.

17. The combustor as in claim 11, wherein at least one tube of the second circuit of tubes includes a plurality of passages that provide for fluid communication into the at least one tube, wherein at least one passage of the plurality of passages is disposed within the first fuel plenum and at least one passage of the plurality of passages is disposed within the second fuel plenum.

18. The combustor as in claim 17, wherein the at least one passage of the plurality of passages disposed within the first fuel plenum is circular and the at least one passage of the plurality of passages disposed within the second fuel plenum is non-circular.

* * * * *

UNITED STATES PATENT AND TRADEMARK OFFICE

CERTIFICATE OF CORRECTION

PATENT NO. : 8,984,887 B2
APPLICATION NO. : 13/244526
DATED : March 24, 2015
INVENTOR(S) : Jonathan Dwight Berry It is certified that error appears in the above-identified patent and that said Letters Patent is hereby corrected as shown below:

IN THE CLAIMS

Column 7, Claim 1, Line 21 reads "perpendicular to the first baffle:" should read --perpendicular to the first baffle;--

Signed and Sealed this
Seventeenth Day of November, 2015

Michelle K. Lee

Michelle K. Lee
*Director of the United States Patent and Trademark Office*